US007610702B2

(12) United States Patent
Brogdanovic

(10) Patent No.: US 7,610,702 B2
(45) Date of Patent: Nov. 3, 2009

(54) 3-DIMENSIONAL OPTICALLY INTERACTIVE CARD CARRIER PRESENTATION PACKAGE

(76) Inventor: George Brogdanovic, 38W. 570 Barb Hill Dr., St. Charles, IL (US) 60175

( * ) Notice: Subject to any disclaimer, the term of this patent is extended or adjusted under 35 U.S.C. 154(b) by 551 days.

(21) Appl. No.: 11/200,607

(22) Filed: Aug. 10, 2005

(65) Prior Publication Data

US 2007/0033846 A1 Feb. 15, 2007

(51) Int. Cl.
*G09F 1/00* (2006.01)

(52) U.S. Cl. ..... 40/124.06; 40/738; 248/174; 428/7; 206/449

(58) Field of Classification Search ..... 40/124.19, 40/124.06–124.08, 738, 610, 611.01, 611.05, 40/611.06; 248/174; 206/449; 229/92.8; 428/7, 14

See application file for complete search history.

(56) References Cited

U.S. PATENT DOCUMENTS 1,375,026 A * 4/1921 Stranders ..... 40/539
1,481,333 A * 1/1924 Agar ..... 206/767
1,670,464 A * 5/1928 Marsh ..... 40/124.07
2,802,565 A * 8/1957 Kabbash ..... 229/125.015
2,840,293 A * 6/1958 Paige ..... 206/736
4,660,931 A * 4/1987 Chevalier ..... 359/474
6,189,729 B1 2/2001 Keller ..... 221/45
6,718,676 B2 * 4/2004 Miska ..... 40/789
6,990,786 B2 * 1/2006 Kilmartin ..... 53/411

* cited by examiner

*Primary Examiner*—Cassandra Davis
(74) *Attorney, Agent, or Firm*—Clifford Kraft

(57) ABSTRACT

A card carrier and presentation device that can assume a flat 2-dimensional configuration and be deformed into a 3-dimensional configuration. The flat configuration is used to carrier the card on a rack for vending. When the card and device is purchased, the card can be removed and inserted into the device after it is deformed into the 3-dimensional configuration. The card can become part of the 3-dimensional structure. The device can be transparent and have optional artwork on a surface that can optically interact with artwork on the card when the device is in the 3-dimensional configuration to create a combined visual effect.

13 Claims, 4 Drawing Sheets

3-DIMENSIONAL OPTICALLY INTERACTIVE CARD CARRIER PRESENTATION PACKAGE

BACKGROUND

1. Field of the Invention

The present invention relates generally to presentation packages for cards and more particularly to a 3-dimensional optically interactive card carrier presentation package.

2. Description of the Prior Art

It is known to present gift cards, telephone cards, greeting cards and other types of cards in flat packages or hangers. In most cases, cards are on a paper or plastic card carrier that can be hung on a self-dispensing rack. Sometimes these cards and carriers have artistic or ornamental features. Generally they are flat and rectangular.

Prior art cards can be attached to a flat carrier by hot melt fugitive glue, tape or other means. In general, the user removes the card and discards the carrier.

It would be advantageous to have a carrier device that would hang flat on a dispensing rack with the card attached, but that could be distorted or folded into a 3-dimensional presentation configuration with the card being part of the 3-dimensional structure. It would also be advantageous to have artwork on the carrier device interact with artwork on the card.

SUMMARY OF THE INVENTION

The present invention relates to a 3-dimensional card presentation carrier device that can be used itself as a gift for presentation of the card. The carrier can have a design or artwork that interacts optically with a design or artwork on the card itself. The carrier can be flat in a 2-dimensional configuration mode for hanging on a dispensing rack, and fold or be distorted into a 3-dimensional configuration by inserting the card or otherwise making the card part of the structure. An optional hanging tab could be removable in the 3-dimensional mode. The device can be made of transparent material such as clear plastic so that any design or artwork on the carrier can optionally interact with artwork on the card.

An example of use of the present invention might be that a parent wants to give a gift of a debit card to a teenager. The card and flat carrier device can be taken off the dispensing rack and purchased. When it is desired to present the gift, the carrier device could be distorted or folded into a 3-dimensional configuration and held in that state by inserting the card into the 3-dimensional structure in a predetermined way. The carrier could be clear plastic with say a water/bubble design. The card could have a fish design. When the card was inserted into the structure, the water/bubble design could optically interact with the fish design on the card giving the illusion of a fish under water.

Several illustrations and drawings have been presented to better aid in the understanding of the present invention. The scope of the present invention is not limited to what is shown in the figures.

DESCRIPTION OF THE INVENTION

Figure 1:
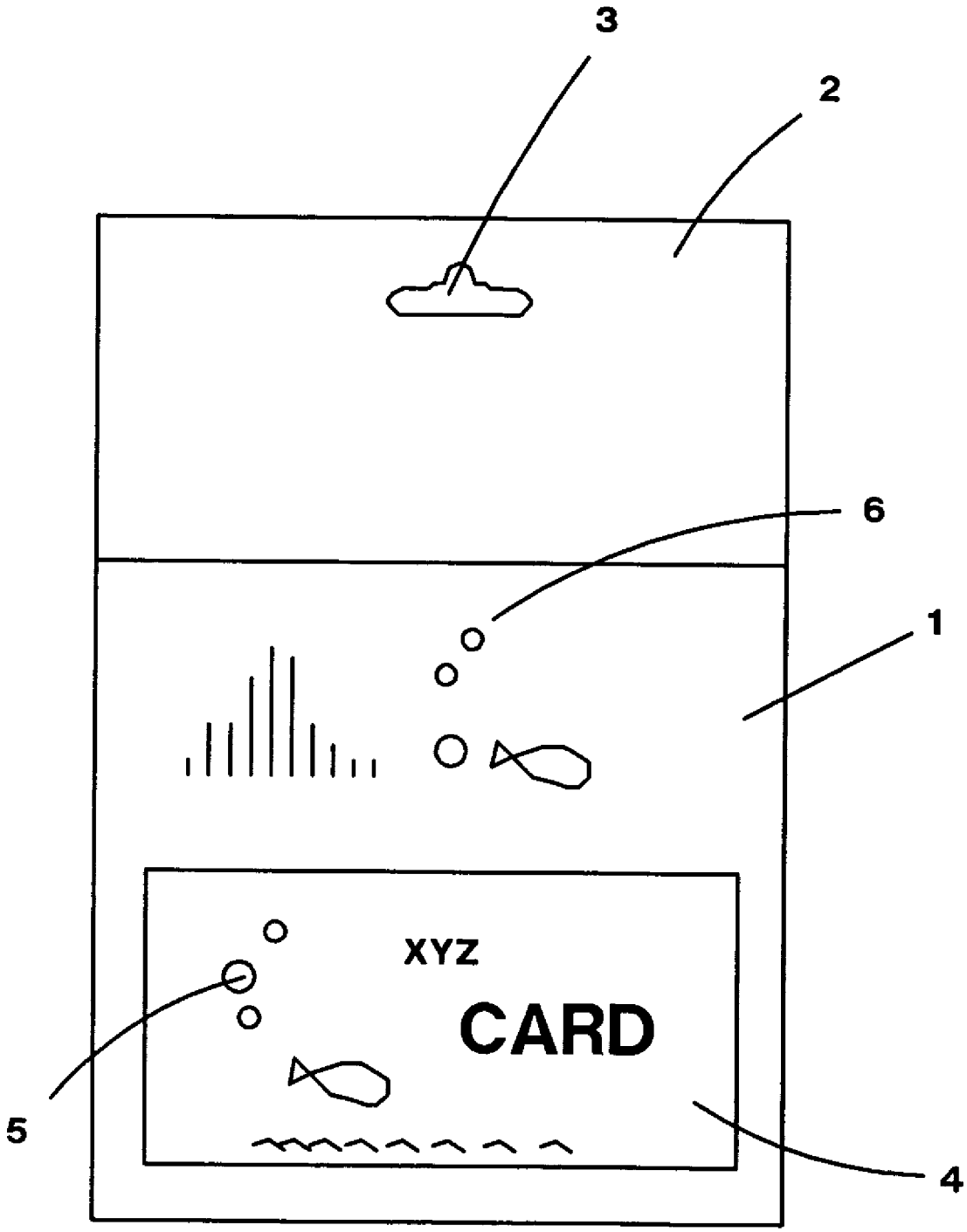
FIG. 1 shows a card on a carrier in a 2-dimensional configuration.

The present invention relates to a card carrier and presentation device and method where a carrier device can assume both a 2-dimensional configuration and a 3-dimensional configuration. Turning to FIG. 1, an embodiment in a 2-dimensional configuration is shown. A clear plastic or other transparent carrier 1 is hung on a carrier or dispensing rack by means of a hole 3 located near the top portion or tab 2. A card 4, such as a gift debit or telephone card, is attached to the bottom portion of the carrier 1. The card 4 can be attached to the carrier 1 with a small amount of fugitive glue or by any other attachment means. The carrier 1 can contain optional artwork 6 or designs. The card 4 can also contain optional other artwork 5 or designs possibly related in theme to the artwork 6 on the carrier 1. Cards can be credit cards, debit cards, telephone cards, gift cards, business cards, greeting cards, or any other type of card of any shape or material for any purpose. Generally cards are made of hard plastic like credit cards; however it is with in the scope of the present invention to both the cards and the carrier from any material.

The carrier can be constructed from two thin layers of material like clear plastic in a particular embodiment of the present invention. The layers can be laid on top of one another in the 2-dimensional mode with layers attached to each other top and bottom or in other manner to produce the ultimate 3-dimensional structure when the structure is distorted. Alternatively, a single layer can be folded or creased at the bottom and then attached about ⅔ or ¾ of the way to the top. The card can be attached for sale to the device by fugitive glue or by any other means.

Figure 2:
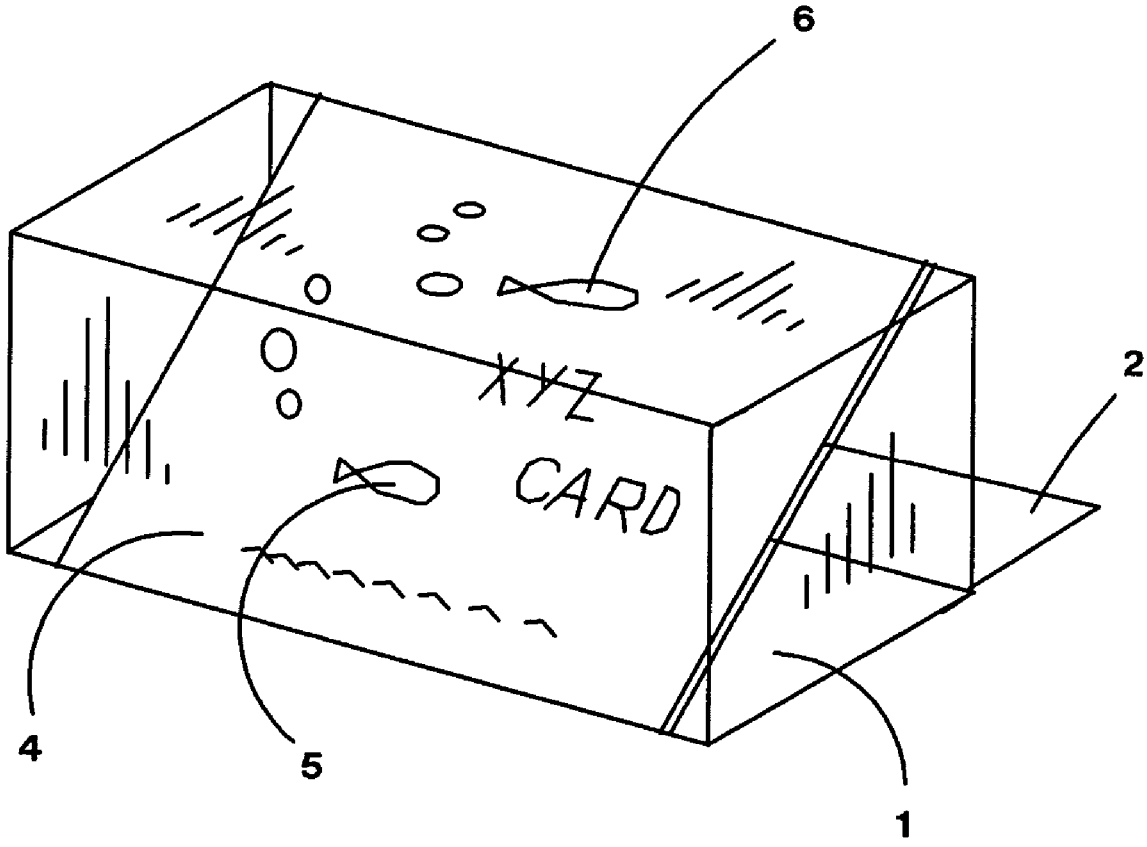
FIG. 2 shows the carrier from FIG. 1 distorted or unfolded into a 3-dimensional configuration with the card inserted as part of the structure.

After the carrier and card are purchased, the buyer can fold or deform the carrier 1 into a 3-dimensional configuration an example of which is shown in FIG. 2. FIG. 2 shows the carrier of FIG. 1 distorted along predefined crease lines into a 3-dimensional configuration and held in that configuration by insertion of the card across the diagonal of the box-like structure. In this particular example, the card simply fits in predetermined creases to hold the 3-dimensional structure together. However, in some cases, with some 3-dimensional designs, holes or tabs may be provided to hold the card in the structure. It should be noted that any shape or design can be used for the carrier. The carrier can be made of any material that is flexible. The preferred material is transparent plastic sheet.

A feature of the present invention is that designs or artwork 6 on the carrier device can optically interact with designs or artwork 5 on the card. FIGS. 1 and 2 show an example of fish and bubbles on both the clear plastic carrier device and the opaque plastic card face. In the 3-dimensional configuration, the user receives the optical impression of fish swimming in a 3-dimensional space.

Figure 3:
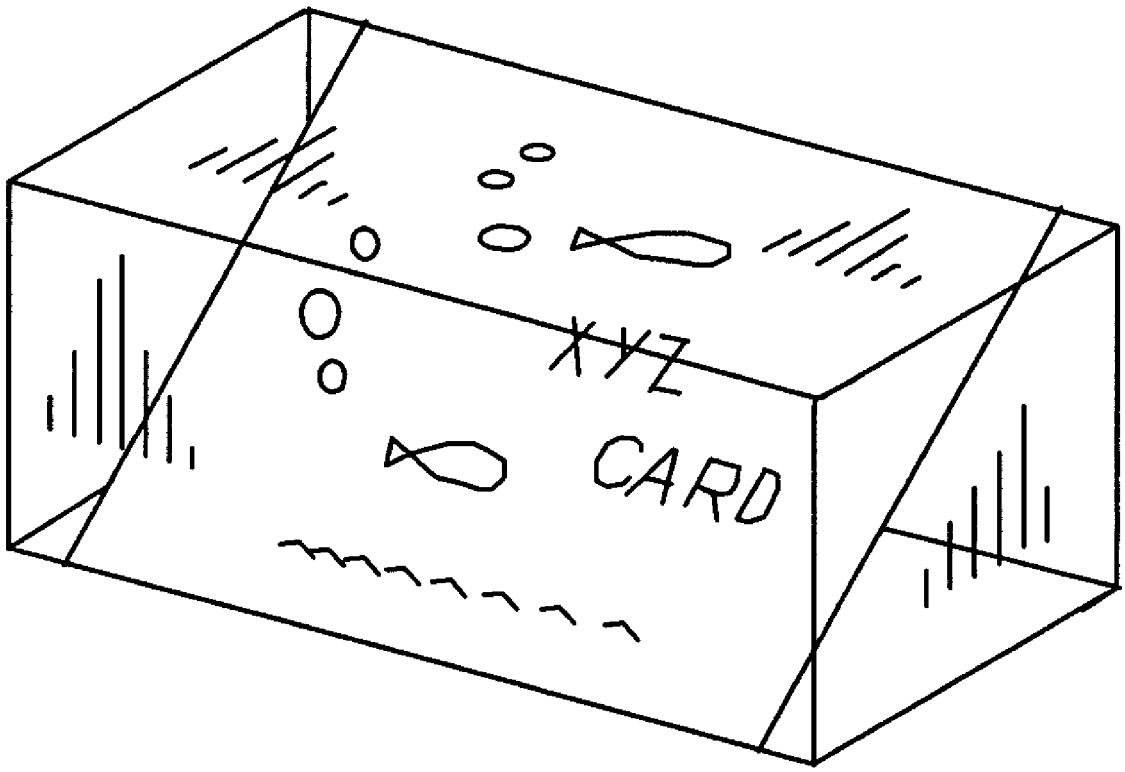
FIG. 3 shows the embodiment of FIG. 2 with the hanging tab removed.

The tab 2 or part of the device used for hanging in the 2-dimensional configuration can be made removable. FIG. 3 shows the embodiment of FIG. 2 with the tab removed. While removing the tab is optional (or making the tab removable is optional), it can lead to a more presentable and complete looking gift.

Figure 4A:
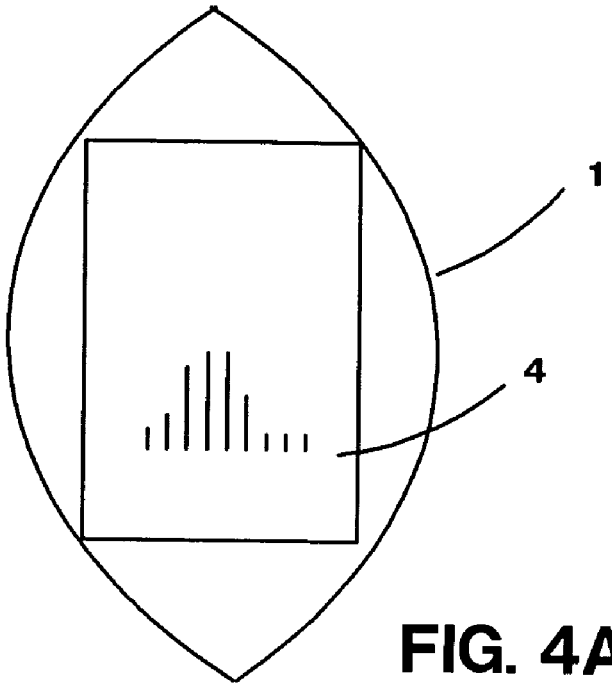
FIGS. 4*a*-4B show a different embodiment of the present invention.
Figure 4B:
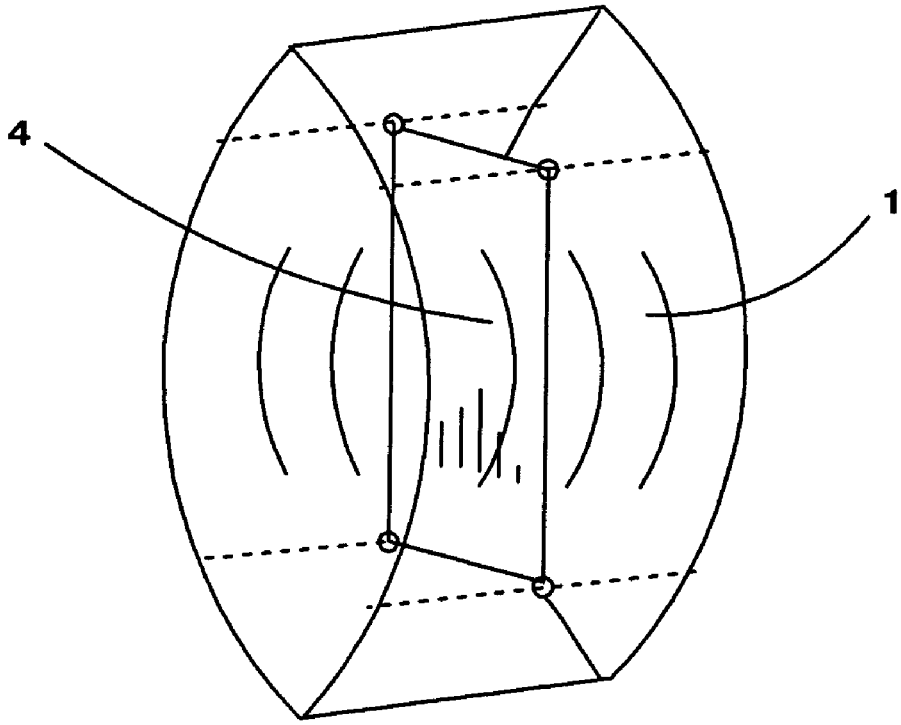

It should be noted that carriers can be made to fold or distort into any 3-dimensional geometrical shape from a 2-dimensional flat configuration. FIGS. 4A and 4B show a completely different geometrical shape resembling a tree ornament. FIG. 4A is an end view, while FIG. 4B is a perspective view of this embodiment. This shape has a generally oval appearance. Carriers can be any shape in the 2-dimensional configuration and need not be rectangular, although rectangular is the most common to fit dispensing racks. The card can be held in the 3-dimensional configuration in any manner or position with the preferred method being that the card stabilizes and holds the carrier in the 3-dimensional configuration. Carriers can be made of any material with clear plastic being preferred so that designs on the plastic carrier device can optically interact with designs on the card. Any means can be used to hold the card in the carrier in the 3-dimensional configuration including holes, tabs creases or simply the shape of the configuration.

The use of optically interacting designs (or designs of any kind) is optional; however, the use of optically interacting designs enhances the card presentation experience dramatically leading to a very special gift.

Various descriptions, illustrations and examples have been presented to better aid in the understanding of the present invention. One skilled in the art will recognize that numerous designs are possible along with many changes and variations. All of these designs, shapes, changes and variations are within the scope of the present invention. The scope of the present invention is not limited to the illustrations, embodiments or examples given.

I claim:

1. A method of presenting cards for sale and for gifts comprising the steps of:

placing a transparent front material layer over a backing layer;

causing said layers to be attached to one-another;

removably attaching a card to said front material layer;

allowing said card to be removed from said front material layer and inserted between said front material layer and said backing layer causing said layers to separate and form a 3-dimensional shape, whereby said card can be presented to a recipient in said 3-dimensional shape;

putting a first artwork design on said front material and a second artwork design on said card such that said first artwork design and said second artwork design optically interact when said layers take said 3-dimensional shape.

2. The method of claim 1 wherein said front material layer is transparent plastic.

3. The method of claim 1 wherein said card has a rectangular shape.

4. The method of claim 1 wherein said card is a gift card.

5. The method of claim 1 wherein said card is a greeting card.

6. The method of claim 1 wherein said card is a telephone card.

7. The method of claim 1 wherein said 3-dimensional shape is a rectangular solid.

8. The method of claim 1 wherein said 3-dimensional shape has a flat bottom.

9. The method of claim 8 wherein said 3-dimensional shape forms a free-standing presentation configuration displaying said card and said artwork design.

10. A method of presenting cards for sale and for gifts comprising the steps of:

placing a transparent front material layer over a backing layer;

causing said layers to be attached to one-another in a 2-dimensional configuration;

removably attaching a card to said front material layer;

allowing said card to be removed from said front material layer and inserted between said front material layer and said backing layer causing said layers to separate and form a 3-dimensional shape, whereby said card can be presented to a recipient in said 3-dimensional shape;

putting an artwork design on said front material such that said artwork design optically interacts with a design on said card when said layers take said 3-dimensional shape and form a 3-dimensional presentation configuration for said card.

11. The method of claim 10 wherein said 3-dimensional shape has a flat bottom.

12. The method of claim 11 wherein said 3-dimensional shape is free-standing on a flat surface.

13. The method of claim 10 wherein said 3-dimensional shape forms a free-standing presentation configuration displaying said card and said artwork design.

* * * * *

UNITED STATES PATENT AND TRADEMARK OFFICE

CERTIFICATE OF CORRECTION

PATENT NO. : 7,610,702 B2
APPLICATION NO. : 11/200607
DATED : November 3, 2009
INVENTOR(S) : George Bogdanovic It is certified that error appears in the above-identified patent and that said Letters Patent is hereby corrected as shown below:

Title Page; item (76);

Correct inventor's name from George Brogdanovic to George Bogdanovic

The correct name is BOGDANOVIC

Signed and Sealed this

Thirtieth Day of March, 2010

David J. Kappos

David J. Kappos
*Director of the United States Patent and Trademark Office*